United States Patent [19]

Sipes

[11] 4,452,413

[45] Jun. 5, 1984

[54] APPARATUS FOR TEMPORARILY SUPPORTING DRILLING EQUIPMENT ON A DRILLING RIG FLOOR

[76] Inventor: Anthony T. Sipes, 4214 S. Wheeling, Tulsa, Okla. 74105

[21] Appl. No.: 425,432

[22] Filed: Sep. 28, 1982

[51] Int. Cl.[3] ..... F16M 11/00

[52] U.S. Cl. ..... 248/176

[58] Field of Search ..... 248/176, 177, 188.4, 248/188.5, 544, 309 A, 539

[56] References Cited

U.S. PATENT DOCUMENTS

| | | | |
|---|---|---|---|
| 3,310,267 | 3/1967 | Koehler | 248/176 |
| 3,370,805 | 2/1968 | Barbee | 248/309 A |
| 3,503,581 | 3/1970 | Rouleau | 248/176 |
| 3,591,118 | 7/1971 | Gentile | 248/309 A |
| 4,275,939 | 6/1981 | Odermann | 248/544 |
| 4,278,222 | 7/1981 | Siegel | 248/176 |

*Primary Examiner*—William H. Schultz
*Assistant Examiner*—Ramon O. Ramirez
*Attorney, Agent, or Firm*—Head, Johnson & Stevenson

[57] ABSTRACT

Apparatus for temporarily supporting drilling equipment such a reamer, shock sub, K.C. wiper, or the like, on a drilling rig floor which has a rotary table with a vertical, cylindrical recess opening, the apparatus being formed of a cylindrical base structure of diameter so that it may be slidably received in the cylindrical opening, an enlarged diameter flange to rest on the rotary table, and an elongated upstanding portion having a lower end affixed to the flange with the upper end being tapered providing a sturdy vertical structure for receiving a tubular piece of drilling equipment, such as a reamer, so that the drilling equipment may be temporarily supported in an upright position to facilitate attaching it to or detaching it from a drill string.

3 Claims, 2 Drawing Figures

APPARATUS FOR TEMPORARILY SUPPORTING DRILLING EQUIPMENT ON A DRILLING RIG FLOOR

SUMMARY OF THE INVENTION

Most oil and gas wells are drilled utilizing rotary drilling rigs. In performing rotary drilling it is sometimes necessary to attach short length tubular devices to a drill string. When going into the hole the drill pipe aready in the hole is supported by slips, and an additional length of drill pipe is elevated into position and supported vertically over the drill pipe suspended in the slips, and the lengths of drill pipe are threaded together. When attaching elevators to a new length of drill pipe to be inserted into the drill string, the connection is usually made by a derrick man working on a catwalk approximately 30 to 40 feet above the height of the drill floor.

A special problem exists when it is necessary to attach a relatively shorter length of drilling equipment in a drill string. For instance, a reamer may be approximately 6 to 8 feet long. Therefore, the workmen on the catwalk cannot assist in connecting the reamer to a drill string. The standard procedure for attaching a reamer is to elevate it into vertical position on the drilling rig floor such as by means of a winch cable. When in such position it must be held vertically by workmen while the lower end of a length of drill pipe is attached to it, or unthreaded from it. To stabilize and support a piece of tubular drilling equipment on the drilling rig floor requires from 1 to 3 workmen to help hold it in an upright position. This, of course, is dangerous as well as exceedingly disagreeable work, particularly when unthreading from a piece of equipment which has been pulled from use in a borehole and thereby is typically be covered with mud, oil, and so forth.

The present invention provides a means of overcoming this difficulty and discloses an apparatus for temporarily supporting relatively short length drilling equipment in a vertical position on the drilling rig floor so that the equipment can be attached or detached from a drilling string. Equipment such as reamers, shock subs, K.C. wipers, and the like, are usually in the range of 6 to 12 feet in length, although equipment as short as 3 feet is sometimes employed. This type of equipment is normally tubular to permit the flow of drilling fluid through it, and the present invention provides an apparatus which includes an elongated upstanding portion temporarily secured to the drilling rig floor in a way such that the special drilling equipment may be lifted into position by an air hoist or the like and set down over the upstanding portion. In this manner it is held uprightly while the lower end of a length of drill pipe is attached to it. In the same manner, when it is desired to detach the special drilling equipment from a string of drill pipe, it can be set over the device of this invention and unthreaded. Thereafter, the device may be removed so that it does not intefere in any way with normal drilling operation.

DESCRIPTION OF THE DRAWING

FIG. 1 shows in dotted outline a special drilling tool such as a reamer as it is temporarily supported by the apparatus.

DETAILED DESCRIPTION

Figures 1, 2:
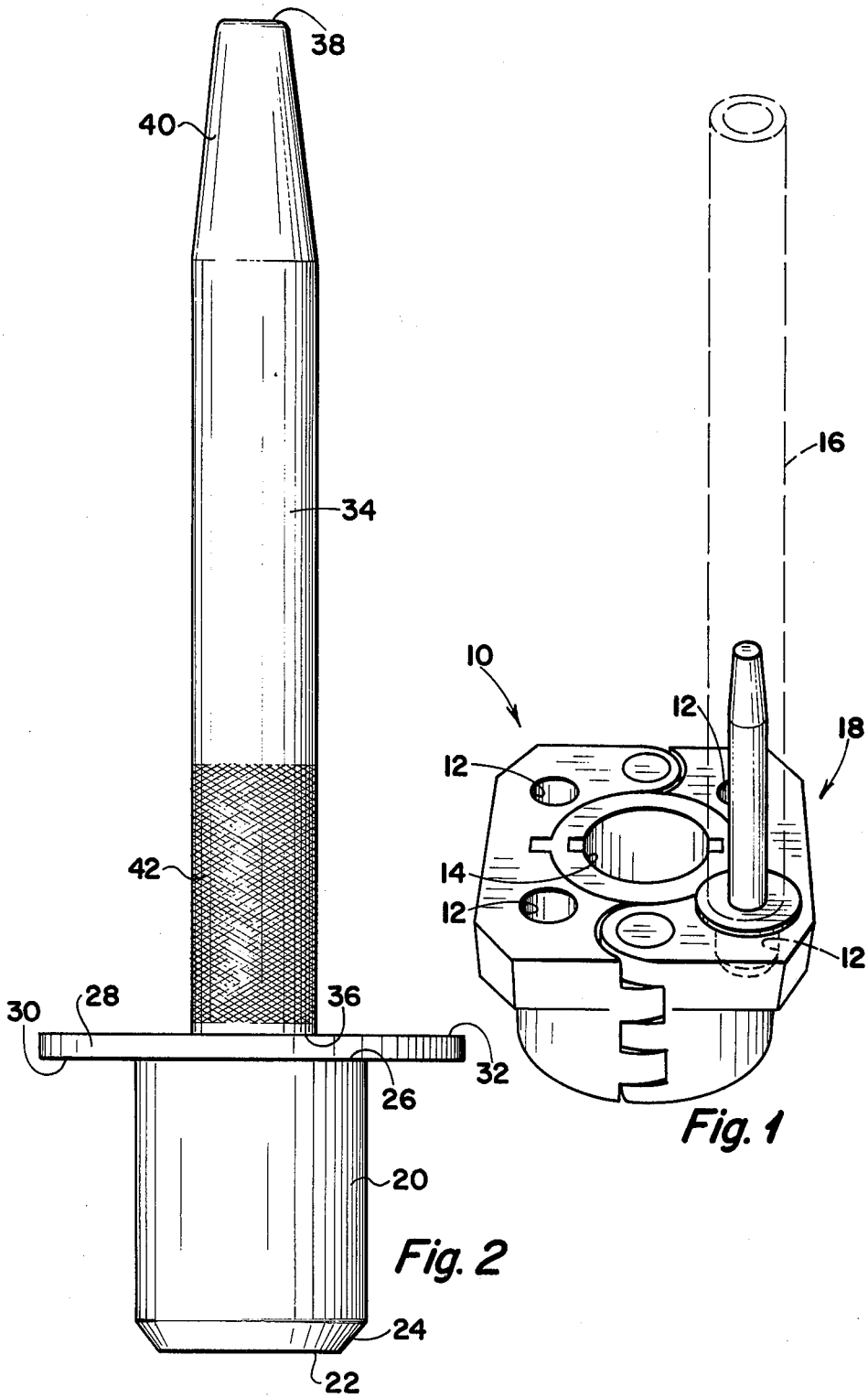
FIG. 1 is an isometric view showing a master bushing as employed on a drilling rig floor, the bushing having drive pin openings therein, and showing the present invention secured in the master bushing in a manner to temporarily support a special drilling tool.
FIG. 2 is an enlarged elevational view of the apparatus of this invention.

Referring first to FIG. 1, a master bushing as employed on a rotary drilling rig is indicated generally by the numeral 10. The master bushing is the device which serves to support and rotate a drill string. Usually, during drilling operations, a kelly drive bushing (not shown) is supported within and on the top of the master bushing 10. In order to securely lock the rotation of the kelly drive bushing to the master bushing 10, the master bushing is provided with four pin openings 12 which are equally spaced from the master bushing central opening 14. The kelly drive bushing is positioned on the master bushing only when a kelly is being employed for applying rotational torque to a length of drill string. During times when a drill string is being made up, that is, when running into the hole, or when making a trip out of the hole, the kelly drive bushing is typically removed from the master bushing so that the top surface of the master bushing appears as in FIG. 1.

The present invention makes use of the pin openings 12 in the master bushing to provide a means of temporarily vertically supporting special elongated tubular drilling tools such as reamers, shock subs, K.C. wipers, or the like. FIG. 1 illustrates in dotted outline a reamer 16 as temporarily supported on the drilling rig floor and more particularly on the master bushing 10, by employment of the support apparatus of this invention which is generally indicated by the numeral 18. The tool 18 is shown in more detail in FIG. 2.

The tool includes a cylindrical base structure 20 which has a diameter slightly less than the internal diameter and a rotary table pin opening 12. Since master bushings 10 are more or less of standard dimensions, even when made by different manufacturers, the pin openings 12 are typically standard throughout the industry. The base structure 12 also has a length which is equal to or less than the depth of pin opening 12. Thereby, the base structure 20 may be telescopically inserted into the pin opening 12. To facilitate insertion of the tool, the bottom end 22 is tapered at 24. The base structure has as top end 26 which is planar.

Secured to the base structure top end 26 is an enlarged diameter flange portion 28. The flange portion has a bottom surface 30 which enagages the base portion top surface 26 and a top surface 32. The flange portion 28 has a diameter significantly larger than the diameter of the pin opening 12 and, therefore, of the base portion 20 so as to give substantial vertical stability to the device.

Extending upwardly from the flange portion 28 is an elongated upstanding portion 34 having a bottom end 36 and a top end 38. The bottom end 36 is secured to the flange portion upper surface 32.

While the base portion 20, flange portion 28, and upstanding portion 34 have been described as separate elements, it can be seen that they can be manufactured of a unitary piece of metal. Another arrangement is to provide a threaded recess (not shown) in the base structure 20 and an integral externally threaded extension portion (not shown) from the upstanding portion 34 which would be threadably received in the opening in the base structure. An opening (not shown) in the flange would receive this threaded extension. Thus the device of FIG. 2 may be made of a single unitary integral machined product or may be made of three separate pieces joined together. In any event, the external configuration and the function of the device would be the same as that shown in FIG. 2.

The diameter of the upstanding portion 34 should be that which is slightly less than the internal diameter of the special drilling equipment 16 which is to be supported by it. In addition, the length of the upstanding portion 34, that is, the height of the upper end 38 above the flange top surface 32, will be determined primarily by the length of the special drilling equipment to be temporarily supported. In the preferred arrangement the base structure 20 is of a length of about 4 to 5 inches with a diameter slightly less than the diameter of a pin opening 12. In most cases this will require a diameter of the base portion 20 of slightly less than 3⅜ inches. The flange portion 28 is preferably about 6 to 8 inches in diameter and about ¼ to ½ inches long or thick, or high. The upstanding portion 34 is preferably about ¾ to 3 inches in diameter, depending, as previously mentioned, on the internal tubular dimensions of the special equipment to be temporarily supported. The upstanding portion 34 is preferably about 8 to 48 inches long.

To facilitate positioning of a tubular special drilling piece of equipment 16 over the upstanding portion 36 the portion adjacent the upper end 38 is tapered as at 40. Since the support apparatus 18 will be used only occasionally and then only for a short periods of time during the course of drilling a well, it is important that it be easily positioned when it is desired to make use of it and easily removed at other times. For this purpose it is especially adaptable to be handled easily by one workman. To facilitate positioning the device into a master bushing pin opening 12 the external surface of the upstanding portion 34 is provided with a non-slip or knurled position 42. The position of the knurled surface 42 should be near the center of gravity of the device, preferably where the center of gravity is slightly below the area of the knurled surface 42 so that workmen can easily handle the device and insert it into or remove it from a pin opening of a master bushing.

While the invention has been described where it is particularly applicable to inserting into a pin opening in a master bushing, it can be seen that the device can be used in any recessed opening on a drilling rig floor which provides secure stability for supporting an elongated member.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed:

1. Apparatus for temporarily telescopically supporting drilling equipment, such as a reamer, shock sub, K.C. wiper, or the like on a drilling rig floor having a rotary table, comprising:

a master bushing with a vertical cylindrical recessed opening therein, such as a pin opening, the master bushing being receivable in a rotary table;

a cylindrical base structure of diameter slightly less than said master bushing pin opening and of length less than such opening, the base structure having an upper end and a tapered lower end;

an enlarged diameter flange portion secured coaxially to said base structure upper end, the flange portion having an upper and lower surface, the lower surface engaging the top surface of a master bushing when the apparatus is in use; and an elongated upstanding portion having a lower end and an upper end, the lower end being affixed to said base structure, and said flange portion being coaxial, the upstanding portion being tapered at the upper end, the upstanding flange portion being of a diameter to telescopically receive thereon an elongated drilling tool having a tubular recess in the lower end, a portion of said upstanding adjacent said flange portion being formed with a rough surface to provide a non-slippery hand hold area.

2. Apparatus for temporarily telescopically supporting drilling equipment on a drilling rig floor according to claim 1 wherein said base structure, said flange portion and said upstanding portion are integrally formed.

3. Apparatus for temporarily telescopically supporting drilling equipment on a drilling rig floor according to claim 1 wherein said base structure is about 4 to 5 inches long and wherein said flange portion is about 6 to 10 inches in diameter and about ¼ to ½ inches long, and wherein said upstanding member is about ¾ to 3 inches in diameter and about 8 to 48 inches long.

* * * * *